United States Patent [19]

Frantz

[11] Patent Number: 4,466,687

[45] Date of Patent: Aug. 21, 1984

[54] LOW PROFILE CONNECTOR PROVIDING HIGH DENSITY APPLICATION

[75] Inventor: Robert H. Frantz, Carlisle, Pa.

[73] Assignee: AMP Incorporated, Harrisburg, Pa.

[21] Appl. No.: 380,169

[22] Filed: May 20, 1982

[51] Int. Cl.[3] ..... H01R 9/02

[52] U.S. Cl. ..... 339/198 H; 339/47 R; 339/99 R

[58] Field of Search ..... 339/198 H, 198 G, 198 GA, 339/96, 97, 98, 99 R, 275 R, 275 T

[56] References Cited

U.S. PATENT DOCUMENTS

| | | | |
|---|---|---|---|
| 3,848,951 | 11/1974 | Michaels | 339/198 H |
| 4,046,452 | 9/1977 | Cassarly | 339/198 H |
| 4,252,397 | 2/1981 | Eigenbrode et al. | 339/99 R |
| 4,322,120 | 3/1982 | Rilling | 339/47 R |

FOREIGN PATENT DOCUMENTS

| | | | |
|---|---|---|---|
| 1526800 | 5/1968 | France | 339/198 H |
| 2072288 | 9/1971 | France | 339/198 H |

*Primary Examiner*—William R. Briggs
*Attorney, Agent, or Firm*—Russell J. Egan

[57] ABSTRACT

An improved electrical connector is disclosed which enables assembly of a plurality of like connectors in a high density array to mate with continuous rows of pin terminals without requiring gaps in the terminals or missing many pin terminals. The connectors have profiled ends which enhance stackability of the connectors so that the end most terminals of adjacent connectors are spaced apart a distance no greater than twice the distance between adjacent terminals in a single connector.

10 Claims, 9 Drawing Figures

40
36
48
42
44
52
38
46
54
50
20
10
22
54
18
16
12
24
30
74
34
32
14
74
76
78

LOW PROFILE CONNECTOR PROVIDING HIGH DENSITY APPLICATION

The present invention pertains to a low profile electric connector and, in particular, to one which provides high stackability capability for use in high density applications.

The prior art is best represented by U.S. Pat. No. 4,252,397 which shows an electrical connector having terminals with insulation piercing first ends used to terminate the individual conductors of a multi-conductor flat cable and oppositely directed second ends used to mate with other terminals, such as a pin array. The difficulty represented by the connector of this patent is that, due to the shape of the associated housing, it is not possible to bring a number of such connectors together so as to terminate a high density array of pin terminals. In the reference connector there is a substantial amount of housing bulk between the edge of the cable and the outer edge of the connector housing. This could constitute a significant amount of wastage of board space in a high density array and prevent usage of such connectors when it is desired to terminate a high density continuous array of pin terminals.

It is therefore the intent of the present invention to overcome this drawback of the prior art and provide an electrical connector which has good stackability for use in effecting termination of high density arrays of pin terminals with a plurality of interfitting and stackable electrical connectors terminating appropriate multi-conductor flat flexible cables. The present invention is an electrical connector housing havng a cable engaging face and an oppositely directed mating face with a plurality of terminal passages extending therebetween. A like plurality of terminals is provided each mounted in an appropriate passage with an insulation piercing conductor engaging portion extending from the cable engaging face and a mating configuration directed towards the mating face. The connector also has a cover with latching means for detachably attaching it to the housing and a plurality of passages each aligned with a respective terminal passage and receiving therein part of the conductor engaging portion of a respective terminal. The housing and cover each having like profiled ends of narrow configuration from the end most terminal passage and interfitting with an adjacent connector such that the distance between the end most terminal passages of two adjacent connectors does not exceed more than twice the spacing between adjacent terminal passages of a single connector.

The present invention will be described by way of example with reference to the accompanying drawings in which.

Figure 1:
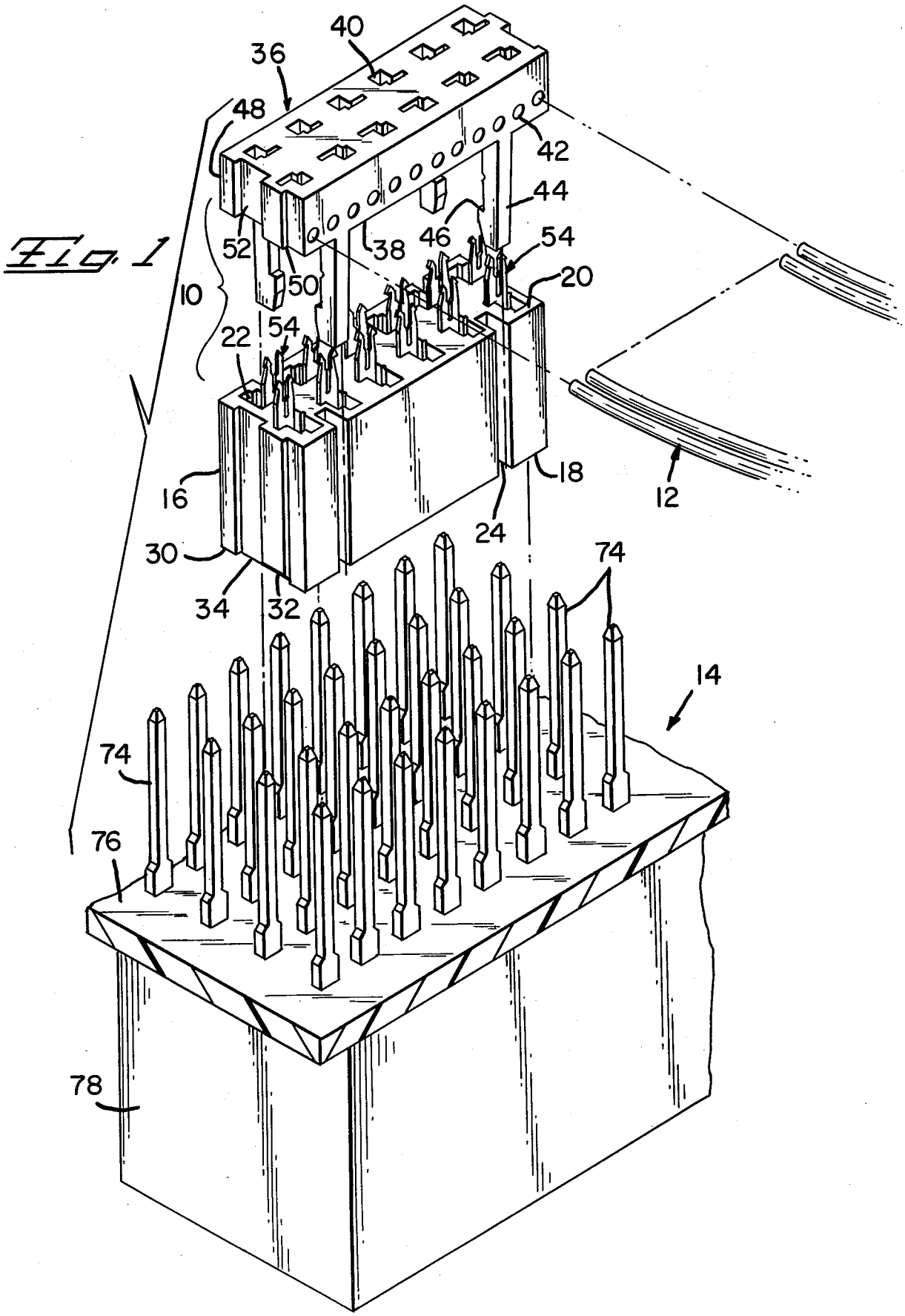
FIG. 1 is an exploded perspective view of a connector according to the present invention, a cable, and a pin array.

The present invention is shown incorporated into an electrical connector 10 for terminating conductors 12 and mating with a pin array 14. The connector 10 has an elongated housing 16 of insulative material with a mating face 18 in an oppositely directed parallel spaced terminating face 20 and a plurality of profiled terminal passages 22 extending between the faces. The housing 16 is also profiled to have at least one latching channel 24 on each opposite elongated side with each channel 24 having spaced first and second lugs 26, 28. The oppositely directed profiled end portions 30 each have a keyed array of projections 32 and channels 34.

The connector 10 also has a cover 36 which is an elongated member of insulative material having an engaging face 38, a plurality of terminal passages 40 in said face, each aligned with a respective terminal passage 22 of the housing, and a plurality of transversely extending conductor passages 42 each one of which intersects a respective terminal passage 40. The cover 36 also includes a plurality of depending latching legs 44 each aligned to enter into a respective latching channel 24 of the housing 16. An inwardly directed shoulder 46 on each leg engages a respective lug 26, 28. The cover has oppositely directed profiled end portions 48 each having a keyed array of projections 50 and channels 52 aligned with the respective projections 32 and channels 34 of the housing to form continuations thereof.

The connector 10 is also provided with a plurality of terminals 54 each mounted in a respective terminal passage 22 with a mating end 56 directed towards the mating face 18 and a conductor engaging end 58 directed towards the terminating face 20. The mating end 56 is formed by a pair of spaced arms 60, 62 which are adapted to receive a pin terminal therebetween making contact with opposite sides thereof. The conductor engaging end 58 is a flat plate defining a pair of tines 64, 66 defining an insulation piercing conductor engaging slot 68 therebetween. The tines 64, 66 each have outwardly directed shoulders 70, 72 adjacent the free ends thereof and adopted to engage in the terminal passages 40 of the cover 36.

The pin array 14 is comprised of a plurality of pin terminals 74 fixedly secured in a spaced array on a circuit board 76. The pin terminals can be of any well known configuration such as that shown in U.S. Pat. No. 4,186,982. The pin array has continuous rows of pin terminals 74, all equally spaced apart. Associated electronic components or a mounting base are schematically illustrated by block 78.

Figure 2:
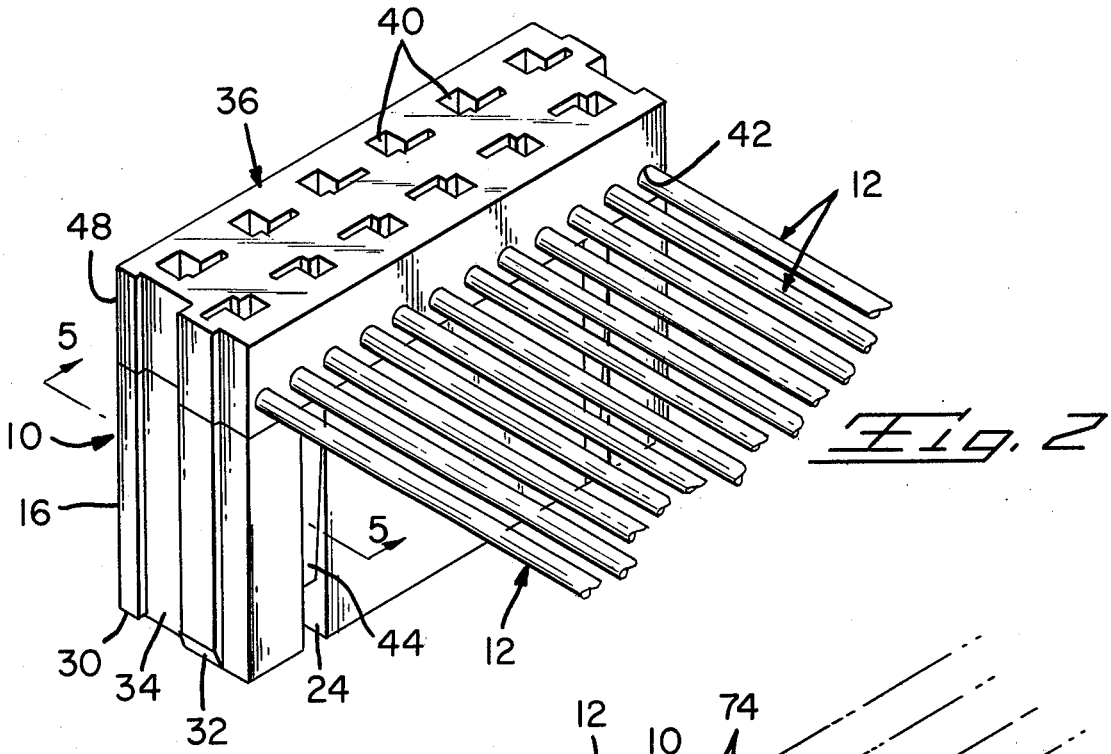
FIG. 2 is a perspective view of a connector according to the present invention terminating a plurality of individual conductors.
Figure 5:
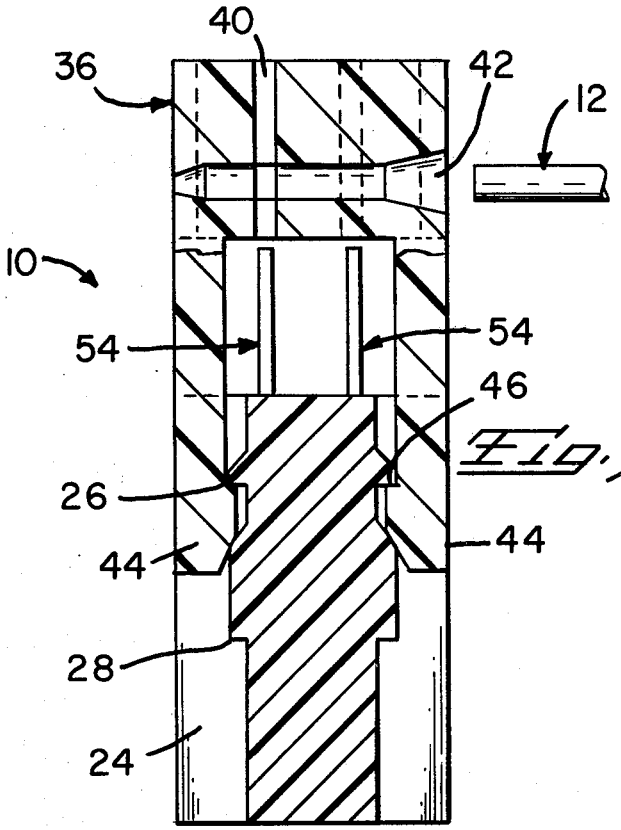
FIG. 5 is a transverse section taken along line 5—5 of FIG. 2 showing the connector according to the present invention in a preterminated condition.
Figure 6:
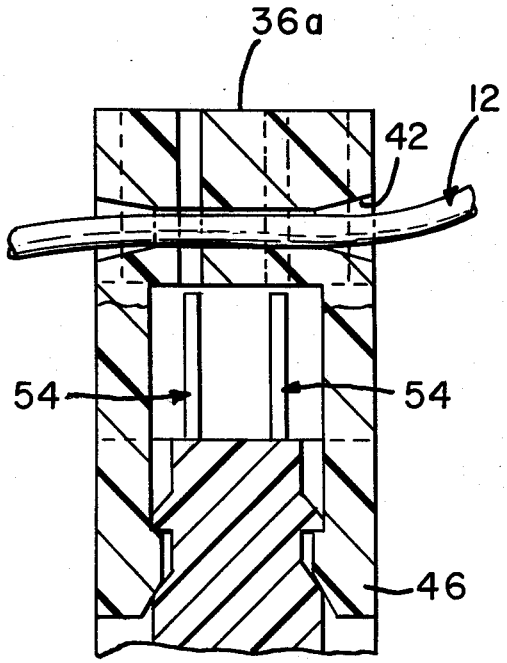
FIG. 6 is a transverse section similar to FIG. 5 showing an embodiment of the subject connector a feed-through or daisy chain termination.
Figure 7:
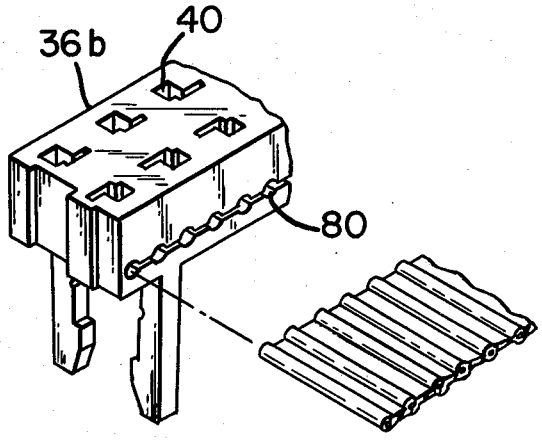
FIG. 7 is a fragmentary perspective view of an alternate cover suitable for use with ribbon cable to be terminated by the connector of the present invention.
Figure 8:
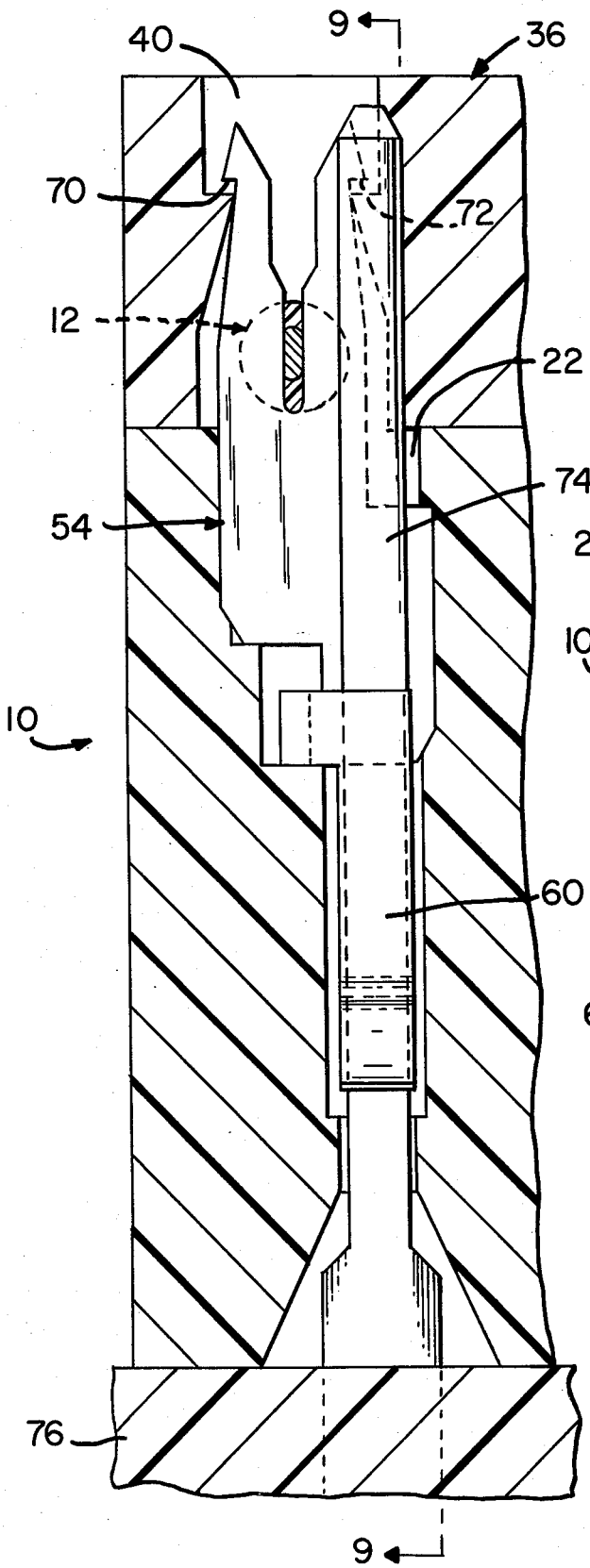
FIG. 8 is a fragmentary vertical section taken along line 8—8 of FIG. 9.
Figure 9:
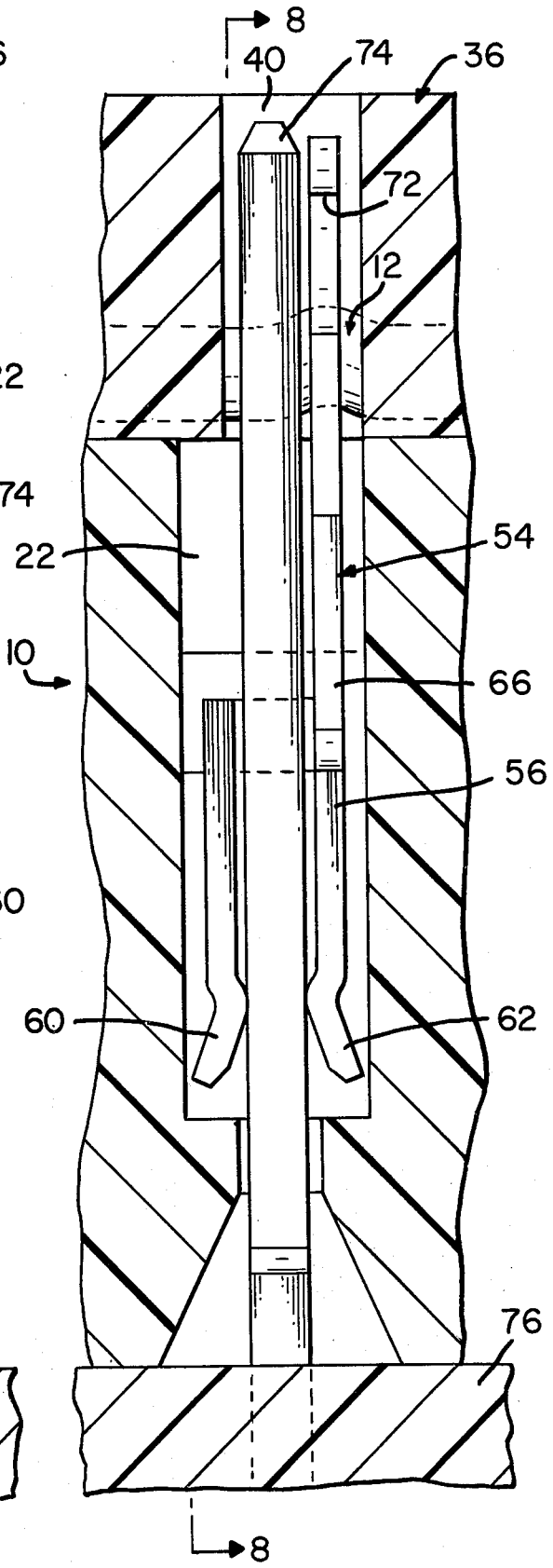
FIG. 9 is a fragmentary vertical section taken along line 9—9 of FIG. 8.

It will be noted from the drawings that the method of terminating a plurality of conductors with the present invention is fairly standard. The terminals 54 are preloaded into the connector housing 16 and the cover 36 can either be loose or preassembled with the connector housing 16 as shown in FIG. 5. The individual conductors 17 are fed into the appropriate passages 42 in the cover 36, see FIG. 5, and the loaded cover 36 is driven down onto the housing to effect the termination of the conductors, as shown in FIGS. 2 and 8. The cover 36 shown in FIG. 5 would be used for an end of conductor termination while the cover 36*a* shown in FIG. 6 would be used for a feed-through or daisy chain termination. The cover 36*b* of FIG. 7 would be suitable for use with a ribbon cable in which all of the conductors are tied together. This cover has a single profiled transverse slot 80. The terminated cable can be mated with the appropriate terminal pins of the pin array 14 by applying the connector 10 thereto.

Figure 3:
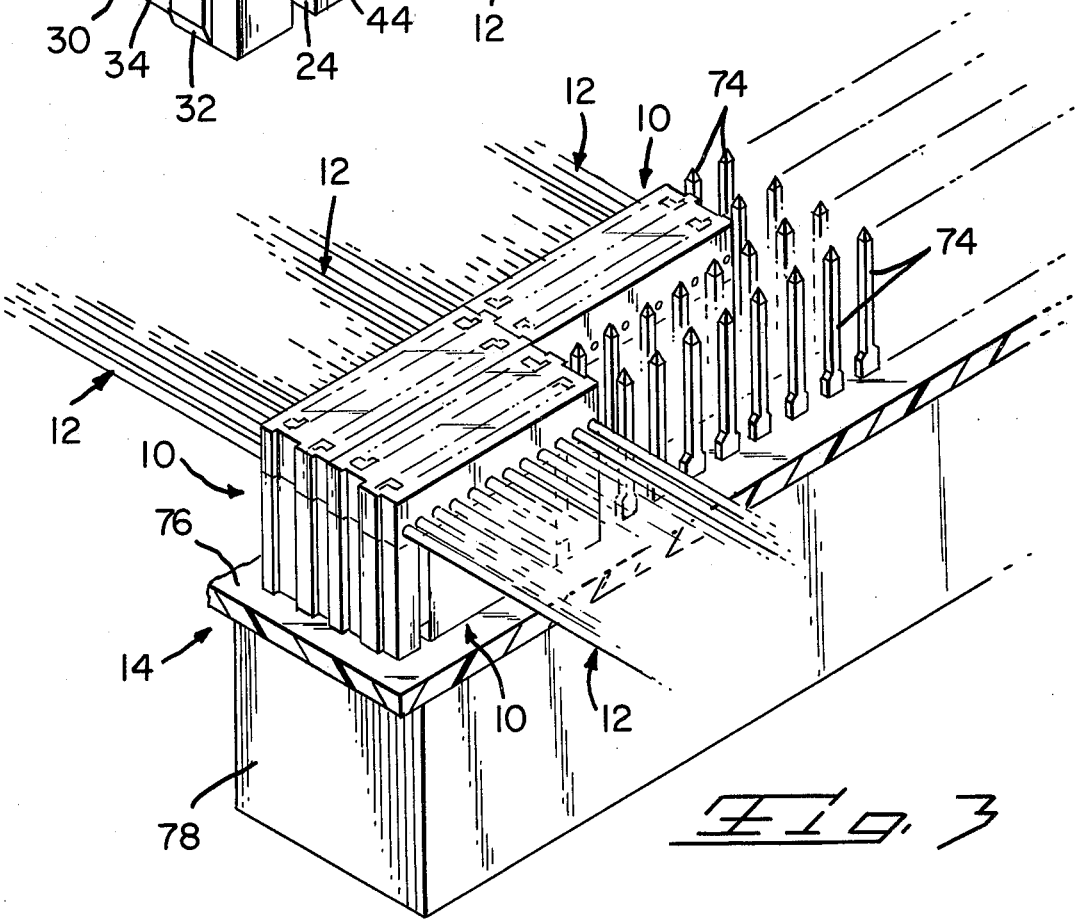
FIG. 3 is a perspective view of a number of electrical connectors according to the present invention terminating individual conductors and mating with multiple pins of a pin array.
Figure 4:
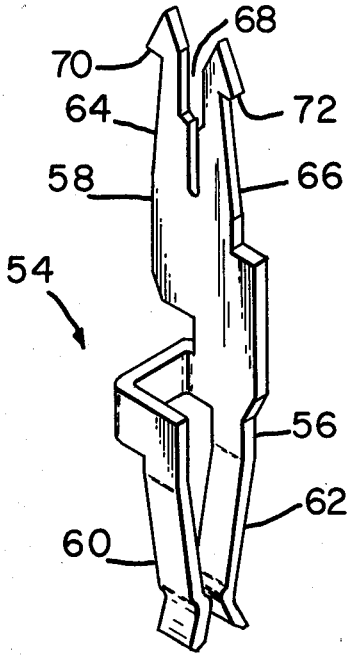
FIG. 4 is a perspective view of an electrical terminal used in a connector according to the present invention.

It will be appreciated from FIG. 3 that because of the unique configuration of the present invention, the subject connectors can be stacked in a closely spaced interlocking array without undue loss in the numbers of pin terminals that are mated, as would be the case for prior art connectors. The pin terminals that are not engaged are received in the channels so that there is no need to remove any pin terminals from a row in order to have proper mating.

I claim:

1. An electrical connector for making an interconnection between conductors and a high density continuous array of fixed uniformly spaced terminals, said connector comprising an elongated housing of insulative material having a mating face and an oppositely directed terminating face with a plurality of terminal passages extending between said faces in at least two parallel spaced rows, a like plurality of terminals each mounted in a respective terminal passage and having a mating portion directed towards said mating face and a conductor engaging portion extending from said terminating face, and a cover adapted to be received on said terminating face of said housing and having therein a like plurality of terminal passages each aligned with a respective terminals passage of said housing, characterized in that opposite end portions of said connector housing and cover are profiled with a keyed series of projections and recesses extending continuously between said housing and said cover whereby like connectors can be stacked in an edgewise arrangement with the end most terminal passages of adjacent connectors being spaced apart a distance no greater than twice the distance between adjacent terminal passages in a single connector.

2. An electrical connector according to claim 1 wherein said cover further comprises:

a plurality of transverse conductor passages each intersecting a respective terminal passage.

3. An electrical connector according to claim 2 wherein each said transverse conductor passage is continuous through said cover whereby said connector can be used for daisy chain termination.

4. An electrical connector according to claim 2 wherein said cover further comprises:

a profiled transverse slot capable of receiving therein a multi-conductor flat cable, the conductors of said cable traversing respective terminal passages.

5. An electrical connector according to claim 1 further comprising:

at least one groove in each elongated side of said housing extending between said faces, at least one latching lug in each said groove, at least one latching leg depending from each elongated side of said cover and positioned to enter a respective groove, and a latching shoulder adjacent the free end of each said leg to latchingly engage a respective latching lug.

6. An electrical connector according to claim 5 wherein a pair of latching lugs are spaced apart in each said groove whereby engagement of said latching shoulders with one of said lugs holds said cover on said housing with said terminating faces spaced apart and engagement with the other of said lugs holds said cover on said housing with said terminating faces substantially abutting.

7. An electrical connector according to claim 1 wherein each said terminal has a mating portion capable of mechanically and electrically receiving a pin terminal therein.

8. An electrical connector according to claim 1 wherein each said terminal has a conductor engaging portion formed by a pair of tines defining an insulation piercing slot therebetween.

9. An electrical connector according to claim 8 wherein each said tine further comprises an outwardly directed shoulder adjacent the free end thereof to grippingly engage in a respective passage of said cover.

10. An electrical connector for use in combination with other like connectors to make interconnection between conductors and a high density uniform array of pin terminals in fixed continuous rows, each said connector having an elongated housing of insulative material with a mating face, an oppositely directed terminating face, and a plurality of terminal passages extending between said faces in at least two parallel rows, an elongated conductor carrying cover of insulative material adapted to be received on said terminating face of said housing and having a like plurality of terminal passages each aligned with a respective terminal passage of said housing, and a plurality of terminals each mounted in a respective terminal passage of said housing with a mating portion directed towards said mating face and an insulation piercing conductor engaging portion extending from said terminating face to engage a respective conductor, characterized in that end portions of said connector housing and cover are profiled with a keyed series of projections and recesses extending continuously between said housing and said cover whereby like connectors can be stacked in an edgewise arrangement with the end most terminal passages of adjacent connectors being spaced apart a distance no greater than twice the distance between adjacent terminal passages in a single connector.

* * * * *